US005219440A

United States Patent [19]

Guse et al.

[11] Patent Number: 5,219,440

[45] Date of Patent: Jun. 15, 1993

[54] SYSTEM FOR CUTTING AND CONVEYING COAL AND THE LIKE

[75] Inventors: Kuno Guse, Witten-Bommern; Günter Upadeck, Bochum, both of Fed. Rep. of Germany

[73] Assignee: Bochumer Eisenhutte Heinzmann GmbH & Co. KG, Bochum, Fed. Rep. of Germany

[21] Appl. No.: 839,520

[22] Filed: Feb. 18, 1992

[30] Foreign Application Priority Data

Feb. 18, 1991 [DE] Fed. Rep. of Germany ..... 4104927

[51] Int. Cl.[5] ..... E21C 25/56

[52] U.S. Cl. ..... 299/43; 198/607

[58] Field of Search ..... 299/34, 43, 47, 48; 198/604, 605, 606, 607

[56] References Cited

U.S. PATENT DOCUMENTS

| | | | |
|---|---|---|---|
| 3,658,385 | 4/1972 | Oven et al. | 299/43 |
| 4,300,673 | 11/1981 | Von Viebahn et al. | 299/43 X |
| 4,733,770 | 3/1988 | Temme | 299/43 X |

FOREIGN PATENT DOCUMENTS

| | | | |
|---|---|---|---|
| 2032471 | 1/1971 | Fed. Rep. of Germany | 299/43 |
| 2149395 | 12/1979 | Fed. Rep. of Germany | 198/606 |
| 3318360 | 4/1985 | Fed. Rep. of Germany . | |
| 3514439 | 2/1987 | Fed. Rep. of Germany . | |
| 700384 | 12/1953 | United Kingdom | 299/43 |

*Primary Examiner*—David J. Bagnell
*Attorney, Agent, or Firm*—Herbert Dubno; Andrew Wilford

[57] ABSTRACT

In a longwall mining operation wherein a takeoff shaft provided with a takeoff conveyor and an access shaft extend crosswise from a longitudinally extending face, a material recovering and conveying system has a chain itself having a longitudinally extending rear stretch extending along the face from a turnaround in the access shaft to a turnaround in the takeoff shaft and a longitudinally extending front stretch extending along the face between the rear stretch and the face. An undriven idler wheel is provided in the takeoff-shaft turnaround over which the chain is engaged between its stretches and a conveyor trough extends between the turnarounds and has a floor formed in the takeoff shaft with a throughgoing outlet hole above the takeoff conveyor. Conveyor/cutting elements on the chain move in the front stretch along the face and in the rear stretch along the trough. A drive motor in the access shaft at the respective turnaround is connected to the chain for advancing it away from the takeoff shaft in the front stretch to scrape material from the face and deposit it in the conveyor trough and for displacing it toward the takeoff shaft in the rear stretch to move the scraped-off material along the trough and deposit it through the outlet hole into the takeoff conveyor.

3 Claims, 3 Drawing Sheets

SYSTEM FOR CUTTING AND CONVEYING COAL AND THE LIKE

FIELD OF THE INVENTION

The present invention relates to a system for cutting a granular mineral material like coal and for conveying it from the cutting location. More particularly this invention concerns a long-wall mining apparatus.

BACKGROUND OF THE INVENTION

A typical longwall mining apparatus such as described in German patent documents 3,318,360 of P. Heintzmann, 3,514,439 of G. Blumenthal, 3,743,239 of G. Blumenthal (U.S. equivalent Pat. No. 4,883,322), and 4,004,488 of K. Plaga (U.S. equivalent Pat. No. 5,088,796) have a main conveyor chain that extends as parallel front and rear stretches along a face being worked between a pair of turnaround locations. One of the turnaround locations is in a takeoff shaft or heading leading back from the face and containing a takeoff conveyor and the other is in an access shaft or heading that normally extends parallel to the takeoff shaft. The rear stretch of the chain runs in a conveyor trough parallel to the face and the front stretch runs along the face being worked. Conveyor/cutting elements mounted on the chain are set in the front stretch in a vertical position in which they engage the face and plow material off it, and are moved in the rear stretch to a horizontal position in the trough where they push the recovered material along to the end of the trough where a takeoff conveyor extending away from the face in the takeoff shaft carries away the recovered material.

As a rule a main drive is provided in the main takeoff shaft where there is substantial room, and an auxiliary drive is provided at the other turnaround location in the small access shaft at the other end of the face being worked. A separate device at the takeoff-shaft turnaround location transfers the material from the conveyor trough to the takeoff conveyor.

Thus the known devices are fairly bulky and quite complex. This is true regardless of the length of the face or whether the device is being used to back-cut the face.

OBJECTS OF THE INVENTION

It is therefore an object of the present invention to provide an improved longwall mining system.

Another object is the provision of such an improved longwall mining system which overcomes the above-given disadvantages, that is which is substantially simpler than the prior-art systems.

SUMMARY OF THE INVENTION

In a longwall mining operation wherein a takeoff shaft provided with a takeoff conveyor and an access shaft extend crosswise from a longitudinally extending face, a material recovering and conveying system according to this invention has a chain itself having a longitudinally extending rear stretch extending along the face from a turnaround in the access shaft to a turnaround in the takeoff shaft and a longitudinally extending front stretch extending along the face between the rear stretch and the face. An undriven idler wheel is provided in the takeoff-shaft turnaround over which the chain is engaged between its stretches and a conveyor trough extends between the turnarounds and has a floor formed in the takeoff shaft with a throughgoing outlet hole above the takeoff conveyor. Conveyor/cutting elements on the chain move in the front stretch along the face and in the rear stretch along the trough. A drive motor in the access shaft at the respective turnaround is connected to the chain for advancing it away from the takeoff shaft in the front stretch to scrape material from the face and deposit it in the conveyor trough and for displacing it toward the takeoff shaft in the rear stretch to move the scraped-off material along the trough and deposit it through the outlet hole into the takeoff conveyor.

This system is based on the discovery that when the face is not too long or the system is being used to back cut the face, it is possible to do away with drives at both ends of the chain. This makes it possible to dump from the conveyor trough directly into the takeoff conveyor, completely eliminating the need for a separate transfer device.

According to a feature of the invention the trough floor lies generally on a floor at the face and has a region that is upwardly deflected above the floor over the takeoff conveyor at the takeoff-shaft turnaround. In addition the takeoff conveyor is mounted on the trough at the takeoff-shaft turnaround.

BRIEF DESCRIPTION OF THE DRAWING

The above and other objects, features, and advantages will become more readily apparent from the following, reference being made to the accompanying drawing in which.

SPECIFIC DESCRIPTION

Figure 1:
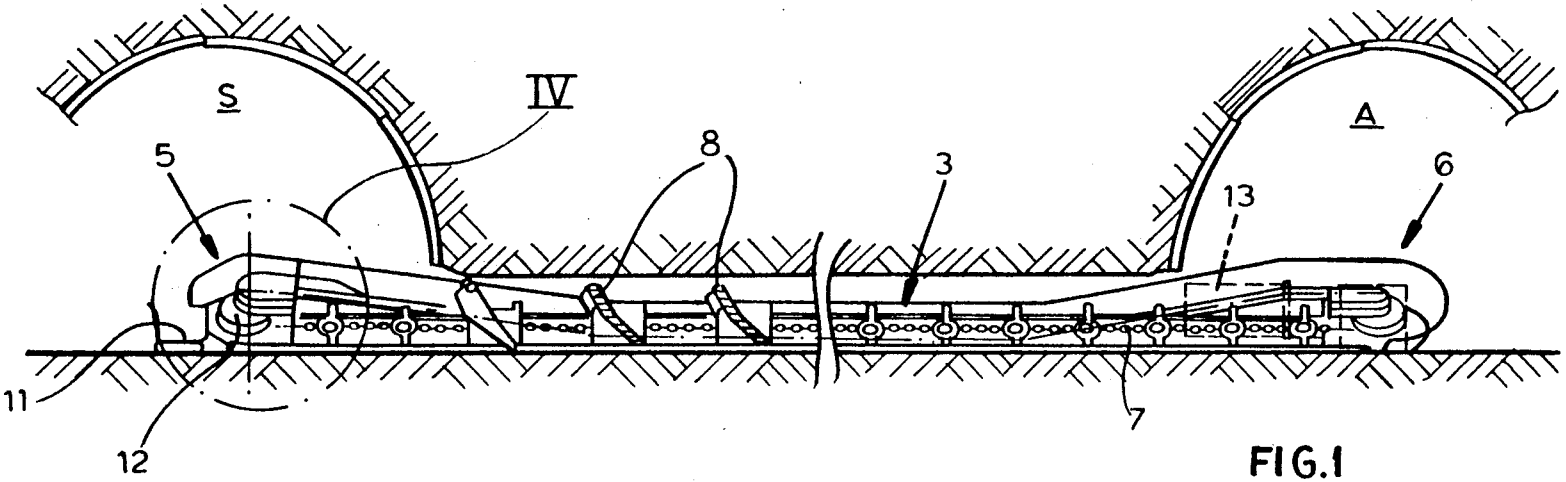
FIG. 1 is a partly diagrammatic end view of the apparatus according to the invention.
Figure 2:
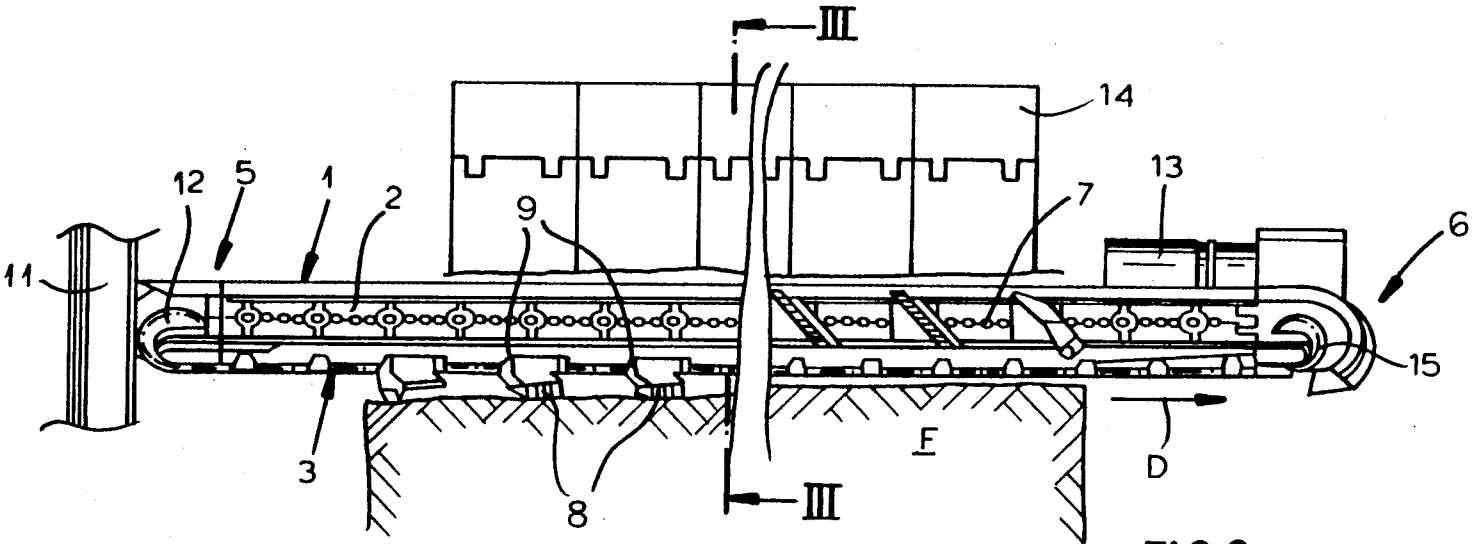
FIG. 2 is a top view of the system of FIG. 1.
Figure 3:
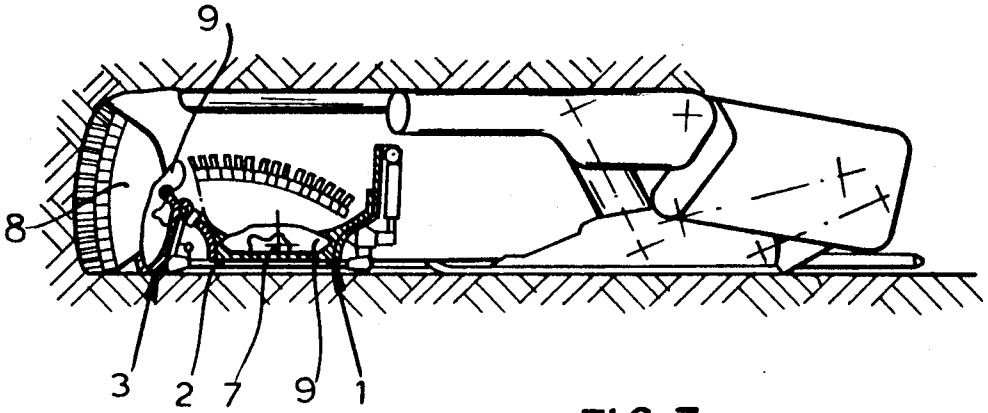
FIG. 3 is a section taken along line III—III of FIG. 1.
Figure 4:
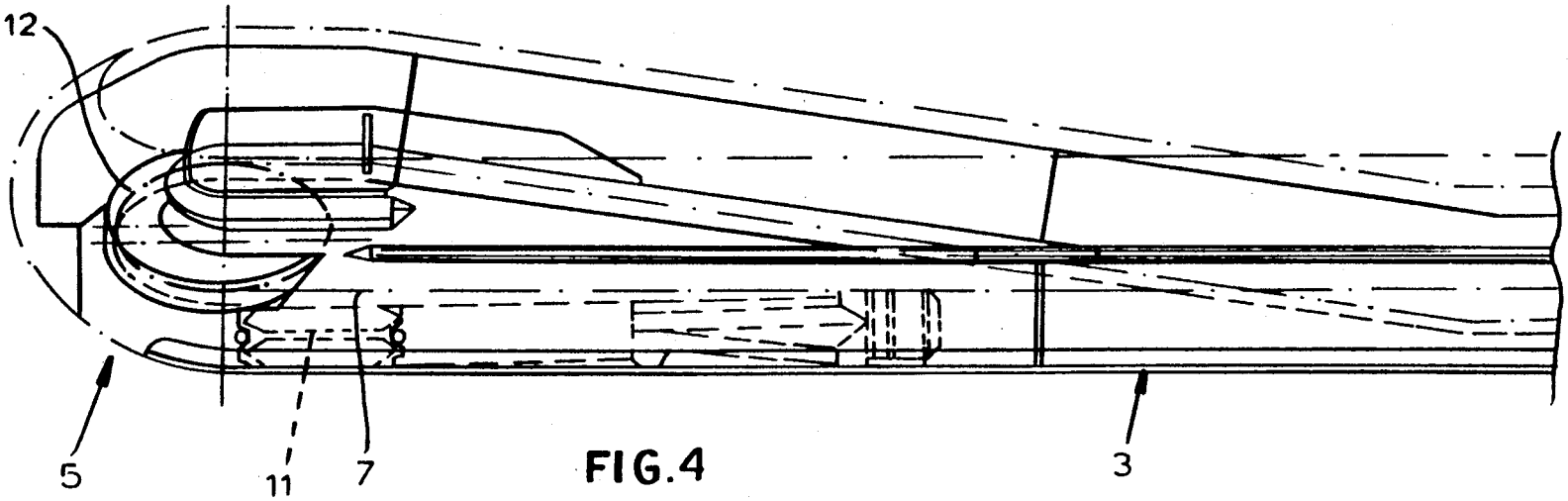
FIG. 4 is a large-scale view of the detail indicated at IV in FIG. 1.
Figure 5:
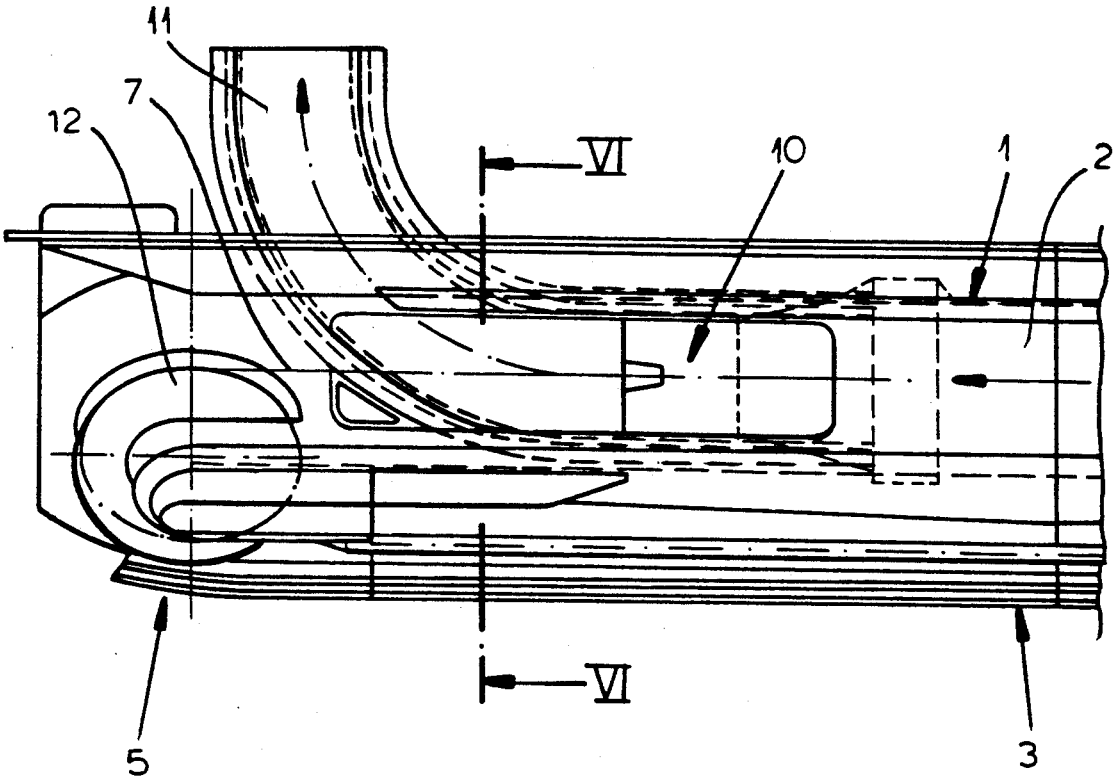
FIG. 5 is a top view of the detail of FIG. 4.
Figure 6:
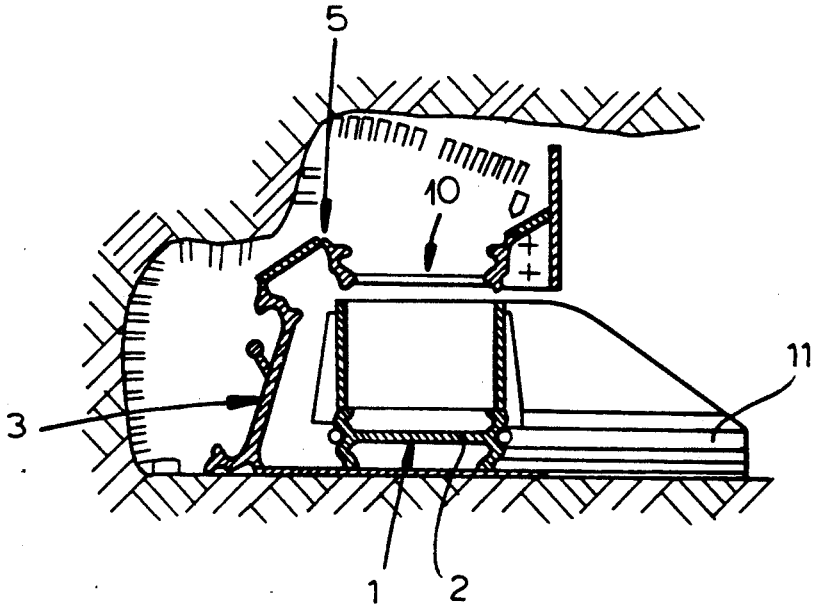
FIG. 6 is a small-scale section taken along line VI—VI of FIG. 5.

As seen in FIGS. 1 and 2 a takeoff shaft S and an access shaft A extend parallel to each other from a longwall face F from which material is to be cut. A chain 7 has a rear conveyor stretch 1 extending in a conveyor trough 2 and a front cutting stretch 3 extending between the trough 2 and the face F. In the shaft S the chain 7 passes at a turnaround location 5 around an undriven idler wheel 12 and in the shaft A it passes at another turnaround location 6 around a sprocket 15 rotated by a heavy-duty drive 13 also located in the shaft A. This chain 7 carries elements 9 that are erect and carry coal plows or cutters 8 in the front stretch 3 and that are recumbent and act as pushers in the trough 2. Thus, as the chain 7 is displaced as indicated for the front stretch 3 at arrow D in FIG. 2, material is cut from the face F by the cutters 8 and is deposited in the trough 2, and then this material is pushed oppositely toward the turnaround location 5 in the trough 2. The mine roof is supported by props 14 behind the advancing longwall face F in the manner well known in the art.

According to the invention as better shown in FIGS. 3 through 6 the trough 2 is deflected upward above the mine floor at the turnaround location 5 and has, just upstream of the wheel 12, a hole or port 10 in its bottom wall so that the conveyed material can drop out into the upstream end of a standard takeoff conveyor 11 that extends back up the takeoff shaft S. There is no drive like the drive 13 at the turnaround 5 so that it is possible to thus deflect the trough 2 so that it dumps directly into the conveyor 11, making possible a clean transfer without any auxiliary equipment.

We claim:

1. In a longwall mining operation wherein a takeoff shaft provided with a takeoff conveyor and an access shaft extend crosswise from a longitudinally extending face, a material recovering and conveying system comprising:

a chain having a longitudinally extending rear stretch extending along the face from a turnaround in the access shaft to a turnaround in the takeoff shaft and a longitudinally extending front stretch extending along the face between the rear stretch and the face;

an undriven idler wheel in the takeoff-shaft turnaround over which the chain is engaged between its stretches;

a conveyor trough extending between the turnarounds and having a floor formed in the takeoff shaft with a throughgoing outlet hole above the takeoff conveyor;

conveyor/cutting elements on the chain displaceable in the front stretch along the face and in the rear stretch along the trough; and a drive motor in the access shaft at the respective turnaround connected to the chain for advancing it away from the takeoff shaft in the front stretch to scrape material from the face and deposit it in the conveyor trough and for displacing it toward the takeoff shaft in the rear stretch to move the scraped-off material along the trough and deposit it through the outlet hole into the takeoff conveyor.

2. The longwall-mining system defined in claim 1 wherein the trough floor lies generally on a floor at the face and has a region that is upwardly deflected above the floor over the takeoff conveyor at the takeoff-shaft turnaround.

3. The longwall-mining system defined in claim 2 wherein the takeoff conveyor is mounted on the trough at the takeoff-shaft turnaround.

* * * * *